United States Patent [19]

Oesterle

[11] 4,404,894

[45] Sep. 20, 1983

[54] VALVE TRIGGER ASSEMBLY FOR PNEUMATIC NAILER

[75] Inventor: Helmut Oesterle, Tosters, Austria

[73] Assignee: Hilti Aktiengesellschaft, Liechtenstein

[21] Appl. No.: 181,951

[22] Filed: Aug. 27, 1980

[51] Int. Cl.[3] ..... F15B 13/042

[52] U.S. Cl. ..... 91/461; 137/625.69; 227/130

[58] Field of Search ..... 91/461; 137/625.69; 227/130; 411/116

[56] References Cited

U.S. PATENT DOCUMENTS

| | | | |
|---|---|---|---|
| 484,731 | 10/1892 | Brown | 411/116 |
| 3,087,162 | 4/1963 | Saurenman et al. | 91/461 UX |
| 3,170,487 | 2/1965 | Juilfs et al. | 227/130 X |
| 3,255,674 | 6/1966 | Nelson et al. | 227/130 X |
| 3,479,926 | 11/1969 | Hillier | 227/130 X |
| 3,708,096 | 1/1973 | Burke, Jr. | 227/130 |
| 3,771,710 | 11/1973 | Perkins et al. | 227/130 |
| 3,871,566 | 3/1975 | Elliesen et al. | 227/130 |
| 4,030,655 | 6/1977 | Rothfuss et al. | 91/461 X |
| 4,197,974 | 4/1980 | Morton et al. | 227/130 X |

FOREIGN PATENT DOCUMENTS

| | | | |
|---|---|---|---|
| 1192396 | 5/1970 | United Kingdom | 227/130 |

*Primary Examiner*—Gerald A. Michalsky
*Attorney, Agent, or Firm*—Hugh D. Jaeger

[57] ABSTRACT

Valve trigger assembly for a pneumatic nailer including a geometrically configured valve bushing having threads at a lower end for securing the assembly into a housing of the nailer and a plurality of O-rings about the configured valve bushing. A geometrically configured valve piston including a plurality of O-rings about the configured valve piston reciprocates in the valve bushing against a spring and is retained in the valve bushing by a snap ring. Small holes in a mid-portion of the valve bushing provide for passage of air supply line pressure for charging the poppet through the valve bushing and large holes in an upper portion of the valve bushing. The large holes also provide for discharge of air behind the poppet and through the valve bushing to the atmosphere. An indented slot in the top of the valve bushing provides for finite adjustment of the valve trigger assembly in the housing of the nailer and hexagonal sides about the top of the valve bushing provide for position locking of the valve bushing in the housing of the nailer with a configured rectangular key which engages into a key indentation in the housing of the nailer.

8 Claims, 7 Drawing Figures

VALVE TRIGGER ASSEMBLY FOR PNEUMATIC NAILER

BACKGROUND OF THE INVENTION

1. Field of the Invention

The present invention relates generally to a pneumatic valve and, more particularly, pertains to a valve trigger assembly for a pneumatic nailer which successively dispenses nails from a magazine and repeatively drives the nails into accepting surface or material.

2. Description of the Prior Art

The valve trigger assembly of the present invention overcomes the disadvantages of the prior art in the following ways as delineated below.

First, the prior art pneumatic nailer housing body was cast which required a lower bushing screwed into the housing and upper bushing pressed into the housing. While the prior bushings of the valve trigger assembly functioned satisfactorily, extra manufacturing time and expense was required as the associated channels were cast into the housing of the nailer.

Second, the prior art valve trigger assembly included a plurality of components and was not of convenient, single-unit construction. Therefore, extra manufacturing time was required as well as extra time for maintenance of the prior art assembly.

Third, and most importantly, the prior art valve trigger assembly failed to provide for easy adjustment for establishing desired trigger height and establishing desired clearance for safety mechanism actuation. Also, the prior art valve trigger assemblies were sometimes difficult to align with the poppet charge-discharge channels and the poppet-exhaust channel and could not be locked into position in the housing of the nailer.

The present invention overcomes the foregoing disadvantages of the prior art by providing a new and novel valve trigger assembly having a convenient one-piece component assembly and provides for easy adjustment of the valve trigger assembly in the housing of the pneumatic nailer. The valve trigger assembly also provides for milling of channels into the housing of the pneumatic nailer which connect the air flow of valve trigger assembly to the poppet assembly and atmosphere of the pneumatic nailer.

SUMMARY OF THE INVENTION

The general purpose of the present invention is a valve trigger assembly for a pneumatic nailer which is easily adjustable in the housing of the nailer, is of one-piece assembly, and utilizes a least number of component parts thereby enhancing reliability. The valve trigger assembly is adjustably screwed and locked into position in the housing of the nailer.

According to one embodiment of the present invention, there is provided a valve trigger assembly for a pneumatic nailer including a geometrically configured valve bushing having threads at a lower end of the bushing, a plurality of small holes in a mid-portion of the bushing where the mid-portion has an outer diameter less than the outer diameter of the bushing, a plurality of large holes in an upper portion of the bushing, a plurality of selectively spaced O-rings positioned in O-ring grooves on each side of the pluralities of holes of the bushing sides, forming a hexagonal configuration on a top portion of the bushing, an indented slot running between opposing intersections of the hexagonal sides, and having a geometrically configured inner diameter including an enlarged inner diameter in a lower portion of the bushing for accepting a geometrically configured valve piston, spring, and snap ring; a geometrically configured valve piston having a longitudinal piston, an upper portion of the piston having a slightly reduced diameter, a retainer member of a larger diameter than the diameter of a lower portion of the piston at the lower end of the piston, a valve stem of a smaller diameter than the diameter of the lower portion of the piston protruding downward from the retainer member, a plurality of spaced O-rings positioned in O-ring grooves in spaced relationship with respect to the pluralities of holes, a spring biasing the valve piston downwardly against the retainer member and retained between the retainer member of the piston and the shoulder of the enlarged inner diameter of the lower portion of the bushing, and a snap ring engaged into a groove in a very lower porion of the enlarged inner diameter of the bushing for retaining the retainer member of the piston in a downwardly biased position in the bushing whereby the valve trigger assembly provides for air passage of air supply line pressure from the small holes to the larger holes between the upper two O-rings of the valve piston internal to the valve bushing for charging a poppet assembly of the pneumatic nailer when the valve piston is in a downwardly biased position in the bushing, and provides for air passage of air pressure above the poppet assembly to the atmosphere on actuation of the valve stem of the valve piston in reverse biasing the valve piston upwardly in the valve bushing where the lower two O-rings of the valve piston isolate and block the small holes stopping air supply line pressure from charging the poppet assembly and air pressure above the poppet assembly flows through channels in the pneumatic nailer from above the poppet assembly, through the large holes, and up along the reduced diameter of the valve piston to an exhaust channel and to the atmosphere thereby providing for firing of the pneumatic nailer and subsequent driving of a fastener such as a nail.

The O-rings positioned on the geometrically configured valve piston are spaced to provide for calculated flow of air between two upper O-rings about the reduced diameter of the valve piston and through the upper inner diameter of the valve bushing from the small holes to the large holes for charging the poppet assembly prior to firing of the pneumatic nailer in dispensing a nail for nailing of a product; and, for calculated flow of air through the larger holes, about the upper portion of the valve piston and through the bushing, and beyond the top O-ring of the valve piston into the atmosphere. The valve piston is biased upwardly against the spring by the trigger assembly of the nailer and blocks the small holes with the two lower O-rings during firing of the pneumatic nailer in dispensing a nail for nailing of the product.

The distance that the middle O-ring on the valve piston has to move upwardly over and above the plurality of small holes is slightly greater than the distance that the upper O-ring on the valve piston has to move above the chamfered edge and slot of the valve bushing when the valve piston is biased upwardly by trigger of the nailer to exhaust pressure from above the poppet assembly into the atmosphere. The distance of movement of the O-rings on the valve piston is calculated so that the upper O-ring on the valve piston first discharges air through the chamfered edge in having to move a short distance; and second, the middle O-ring on the valve piston moves a greater distance over the same holes so that air pressure minutely drops and, then reverse flow of air from the poppet assembly, through channels, through the larger holes, up through and between the valve piston and valve bushing, and up through poppet exhaust channel occurs exhausting air pressure of the poppet assembly into the atmosphere.

A significant aspect and feature of the present invention is a valve trigger assembly for a pneumatic nailer where the valve trigger assembly is an adjustable one-piece assembly and has a least number of components. The valve trigger assembly includes a geometrically configured valve bushing having a plurality of spaced large holes and small holes, a geometrically configured valve piston, O-rings, a biasing spring and a snap ring. This least number of components enhances adjustability, reliability, lockability, and provides for least cost of manufacture and assembly.

Another important, significant aspect and feature of the present invention is a valve trigger assembly which is adjustable and is lockable into a fixed position in the housing of the pneumatic nailer with a substantially rectangular key which is accepted by a key indentation in the housing of the nailer. A lower portion of the valve bushing assembly is threaded which screws into a threaded lower valve bushing bore of the housing of the nailer, and the upper portion of the valve bushing engages into position in the upper valve bushing bore in the housing. The slot disposed in the top of the valve bushing provides for tool access for adjustment of the valve trigger assembly in the housing of the nailer. A substantially rectangular key engages into a key groove in a horizontal plane of the nailer housing and locks against one of the hexagonal sides at the top of the valve bushing of the valve trigger assembly.

A further significant aspect and feature of the present invention is a valve trigger assembly which is utilized in a housing of a pneumatic nailer or pneumatic equipment in general where the housing can be cast from a suitable material, and subsequently bored, milled, and threaded for accepting the valve trigger assembly.

Having thus described the present invention, it is a principal object to provide a valve trigger assembly for a pneumatic nailer.

An objective of the present invention is to provide a pneumatic nailer including the valve trigger assembly of the present invention which is of the utmost quality, and is rugged and dependable for use in heavy-duty construction by construction workers, tradespeople, and industry. The valve trigger assembly of the pneumatic nailer provides enhanced operation and reliability in operation of the pneumatic nailer.

Another objective of the present invention is to provide a valve trigger assembly for a pneumatic nailer which is adjustable in the housing of the nailer, and is lockable and unlockable in position in the housing of the nailer. The valve trigger assembly includes an indented slot in the top of the valve bushing and flat-faced sides in a hexagonal geometrical configuration surrounding the top of the valve bushing where a key engages into the key indentation and against one of the hexagonal sides of the valve bushing.

A further objective of the present invention is a valve trigger assembly of one-piece component assembly providing for enhanced reliability of operation in the pneumatic nailer, but most importantly, for adjustment of the valve trigger assembly in the housing of the pneumatic nailer. The adjustment provides for setting of the clearance between the trigger and the safety mechanism including the safety yoke, safety yoke detent and safety yoke pin, and also provides for alignment of the valve bushing with the air channels internal in the housing of the nailer.

The valve trigger assembly of the present invention while being disclosed and illustrated in an operative embodiment of the pneumatic nailer can also be used in other types of pneumatic tools and equipment, and is not to be construed as limiting in use of the present invention as the present invention has other uses in pneumatic tools or pneumatic equipment in general. Other types of pneumatic tools can include fastener tools.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein:

FIG. 1 illustrates a valve trigger assembly in dashed lines of a preferred embodiment of the present invention in a front plan view of a pneumatic nailer;

DESCRIPTION OF EMBODIMENTS

Figure 2:
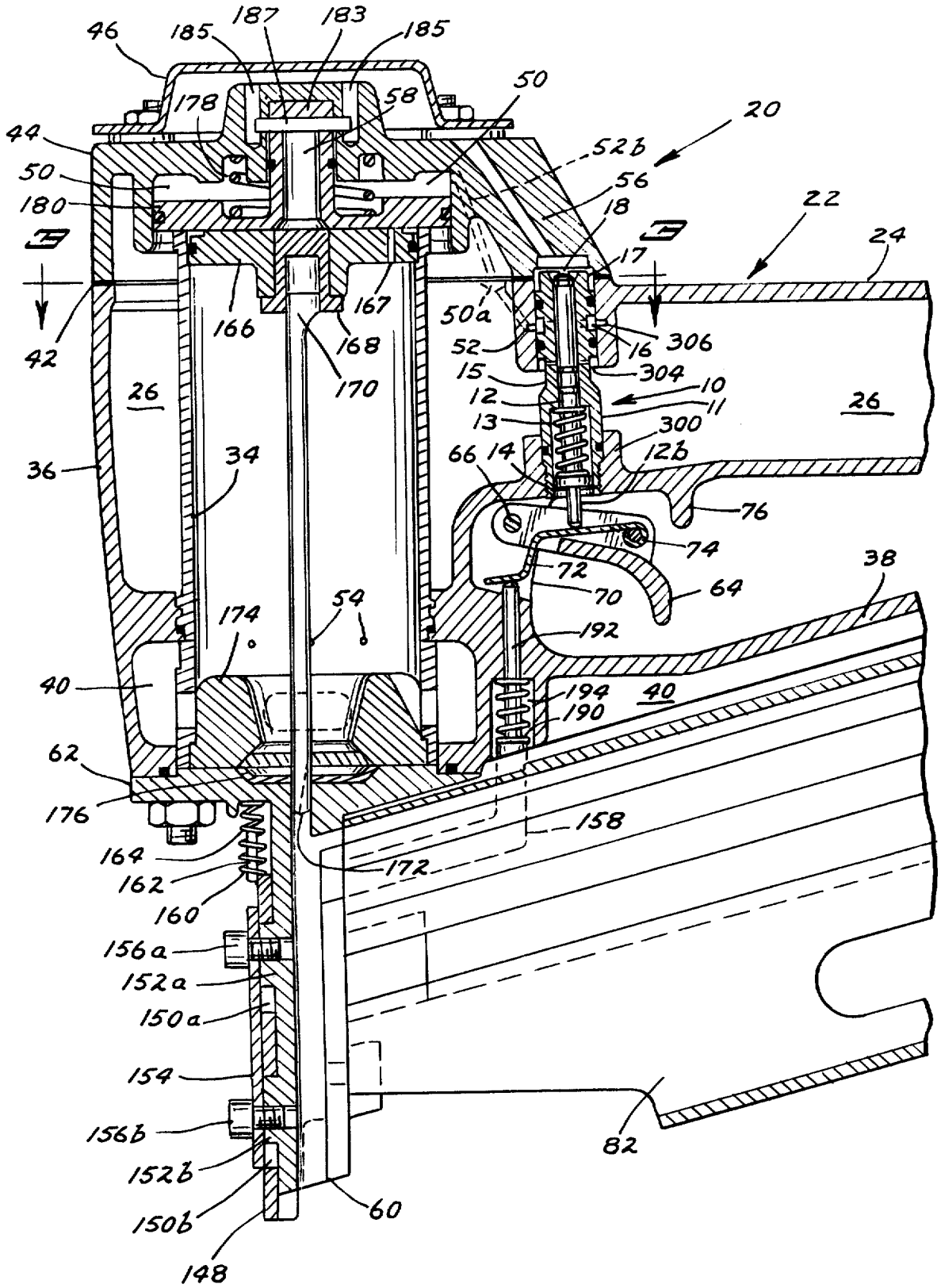
FIG. 2 illustrates a sectional view of the valve trigger assembly in the pneumatic cylindrical body of the nailer.

FIG. 1 illustrates a valve trigger assembly 10, the present invention, illustrated in dashed lines, including a geometrically configured valve bushing 11, a geometrically configured valve piston 12 which reciprocates within the valve bushing 11, a spring 13 surrounding the valve piston 12 and internal to the valve bushing 11 as illustrated in FIG. 2, a snap ring 14 retaining the valve piston 12 and the spring 13 within the valve bushing 11 as illustrated in FIG. 2, a plurality of small holes 15 in a mid-portion of the configured valve bushing 11 as illustrated in FIG. 2, a plurality of large holes 16 in an upper portion of the configured valve bushing 11 as illustrated in FIG. 2, and a plurality of O-rings about the configured valve bushing 11 and configured valve piston 12 as later described in FIG. 2 where the valve trigger assembly 10 is positioned in a pneumatic nailer 20 as now described in detail.

The nailer structure 20 is described in detail in U.S. Pat. No. 4,197,974 issued on Apr. 15, 1980, which is assigned to the assignee of the present invention. The trigger valve assembly of U.S. Pat. No. 4,197,974 is replaced by the structure disclosed of new and novel valve trigger assembly 10 of the present invention. The valve trigger assembly 10 is now described in detail and is particularly illustrated in FIGS. 5 and 6 in addition to the other figures of the drawings.

Housing 22 of the nailer 20 includes an upper handle 24 having a first integral internal air chamber 26 extending from a supply line air passage 28 in an end 30 of the housing 22, a round the valve trigger assembly 10 as also illustrated in FIG. 2, and completely surrounding an upper portion of a cylinder assembly 34 as illustrated in FIG. 2 in a cylindrical body 36 of the housing 22. A lower handle 38 includes a second integral internal air chamber 40 extending from the end 30 of the housing 22 and completely surrounding the lower portion of the cylinder assembly 34 as illustrated in FIG. 2. Staybolts as illustrated in the figure and not numbered for purposes of clarity in the illustration extend from within the top of the cylindrical body 36, through a gasket 42, a cap 44, and an exhaust deflector 46. Suitable nuts are provided on the end of each staybolt to secure the gasket 42, the cap 44, and the exhaust deflector 46 to the cylindrical body 36. The cap 44 accommodates a third integral internal air chamber 50 as illustrated in FIG. 2. Four staybolts as illustrated in the figure and not numbered for purposes of clarity in the illustration extend from within the bottom of the cylindrical body 36 through a nose 60 having a contiguous base 62. Suitable nuts secure the base 62 to the bottom of the cylindrical body 36. A trigger 64 pivotally mounts on a trigger spiral pin 66 affixed between opposing body bosses 68 and 70 as illustrated in FIG. 2, and extends outwardly away from the cylindrical body 36. A secondary trigger 72 pivotally mounts on a secondary trigger spiral pin 74 internal to the trigger 64. A trigger boss 76 affixes to the underside of the upper handle 24 behind the trigger 64. The valve piston 12 having a valve stem **12*b* extends down through the upper handle 24, and is actuated by the secondary trigger 72**.

A nail magazine 82 mechanically engages and frictionally locks to the nose 60. The magazine 82 comprises a longitudinal nail channel 84 having a longitudinal tee slot 86; first nail channel rail and second nail channel rail opposing the first nail channel rail which support a plurality of nails 106 where each nail includes a head and shank attached to the head of the nail; a longitudinal pusher channel 92 having an upper pusher rail **94*a* and a lower pusher rail 94*b*; a longitudinal support channel 96 having a support channel rail; and, a base 100. A loading slot 102 is disposed on the top of the longitudinal tee slot 86 of the nail channel 84 towards an outer end 104 of the magazine for permitting the insertion of a plurality of nails 106, collated together with a suitable material. A nail head track 110 extruded from a suitable material is disposed in the tee slot 86 of the longitudinal nail channel 84. A stop 112 affixes in the outer end 104 of the magazine 82 between the second nail rail 90*b* of the nail channel 84 and the lower rail 94*b* of the pusher channel 92 with a screw 114**.

A pusher 116 includes an angled front vee-shaped groove 118 in a forward end of the pusher 116, an inner pusher channel upper tab **118*a* and an inner pusher channel lower tab 188*b* which rides in the longitudinal pusher channel 92, an outer pusher rail upper tab 120*a* and a outer pusher rail lower tab 120*b* which ride on the outside of the pusher rails 94*a* and 94*b* respectively, and an outwardly extending configured handle 122**.

One end of a scroll spring 124 fastens with a screw 126 to the forward end of the pusher 116 and the other end of scroll spring 124 connects to drum 128. The drum 128 containing the wound scroll spring 124 is rotatably mounted on a drum spacer 130, and a scroll spring cover 132 covers the drum 128. The drum 128 and the drum spacer 130 are rotatably mounted on a scroll drum tab 134 by a bolt **136*a*, washer 136*b* and nut 136*c*** as illustrated in the figure.

A safety yoke detent 140 as illustrated in dashed lines slidably mounts between the nail channel rail **90*b* and the lower pusher rail 94*b* and slides through a lower pusher rail channel hole 142. A safety yoke detent arm 140*a* protrudes through the hole 142 in the lower pusher rail 94*b*. A compression spring 144 slides over the safety yoke detent arm 140*a* and engages into a hole 146 for biasing the safety yoke detent 140 towards the outer end 104 of the magazine 82** as illustrated in the figure.

A uniquely configured three-sided safety yoke 148 having upper and lower elongated holes surrounds a front face and two sides of the nose 60, and slidably reciprocates on the nose 60 about upper and lower elongated bosses on the front face of the nose 60. A plate 154 secures to the bosses with screws **156*a* in FIG. 2 and 156*b*, and provides upward reciprocating movement of the safety yoke 148 between the plate 154 and the nose 60. The bosses protruding outwardly from the nose 60 are of a greater height than the thickness of the safety yoke 148 thereby permitting sliding movement of the safety yoke 148 between the plate 154 and the nose 60. A safety yoke lever 158 in FIG. 2 integral to the safety yoke 148 extends from a right side of the safety yoke 148 for actuating safety yoke pin 192 which is biased downward by a compression spring 190 as also illustrated in FIG. 2. A compression spring 160 fits over a spring retainer 162 protruding upwardly on the safety yoke 148 and is accommodated by a hole 164 in the base 62 of the nose 60. A detent notch 166 in a left side of the safety yoke 148 accommodated the front portion of the safety yoke detent 140**.

FIG. 2 illustrates a sectional view of the cylindrical body 36 of the nailer 20 showing the housing 22, the first integral internal air chamber 26, the upper handle 24, the valve trigger assembly 10, the cylinder assembly 34, the lower handle 38, the second integral internal air chamber 40, the gasket 42, the cap 44, the exhaust deflector 46, the third integral internal air chamber 50, the nose 60, the base of the nose 62, the trigger 64, the trigger spiral pin 66, the opposing boss 70, the secondary trigger 72, the secondary trigger spiral pin 74, the trigger boss 76, the valve piston 12, the magazine 82, the safety yoke 148 having two elongated holes **150*a* and 150*b*, two elongated bosses 152*a* and 152*b* on the nose 60, the plate 154, the screws 156*a* and 156*b*, the integral safety yoke lever 158 extending from the safety yoke 148, the compression spring 160, the spring retainer 162, and the hole 164 in the base 62 of the nose 60**.

A piston bushing 168 secures a driver blade 170 including a tapered end 172 to a piston assembly 166. A bumper 174 mounts in the bottom of the cylinder assembly 34. A driver seal 176 mounts between the bumper 174 and the top of the base 62 of the nose 60. A compression spring 178 forces a poppet assembly 180 down onto the top of the cylinder assembly 34. An exhaust seal 183 positions in the top of the cap 44 directly above the poppet assembly 180. A plurality of bores 185 to an accumulator chamber 187 are in the cap 44 surrounding poppet assembly 180. A compression spring 190 biases a safety yoke pin 192 vertically downward in a hole 194 in the cylindrical body 36 against the integral safety yoke lever 158 of the safety yoke 148.

Figure 5:
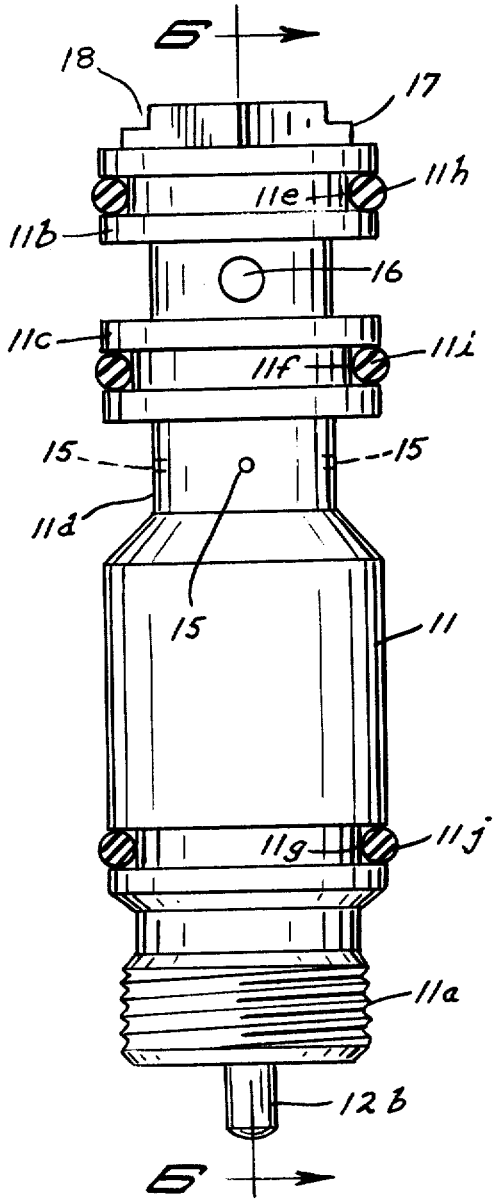
FIG. 5 illustrates an enlarged longitudinal view of the valve trigger assembly.

A lower threaded valve bushing bore 300 accepts threads 11*a* of the brass valve bushing 11, and an upper bushing bore 302 accepts configured upper portions 11*b* and 11*c* of the valve bushing 11 as also illustrated in FIG. 5. An inner space 304 exists between configured mid-portion 11*d* and the interior diameter of the upper bushing bore 302. A lower channel 52 in the housing 22 includes a countersunk hole 52*a* for alignment with an upper channel 52*b* in the cap 44. A circular channel 306 which is an accumulator chamber surrounds the plurality of large holes 16 and connects to the lower channel 52.

U.S. Pat. No. 4,197,974 further discusses and illustrates in detail the elements as described above and as illustrated in FIGS. 1 and 2.

Figure 3:
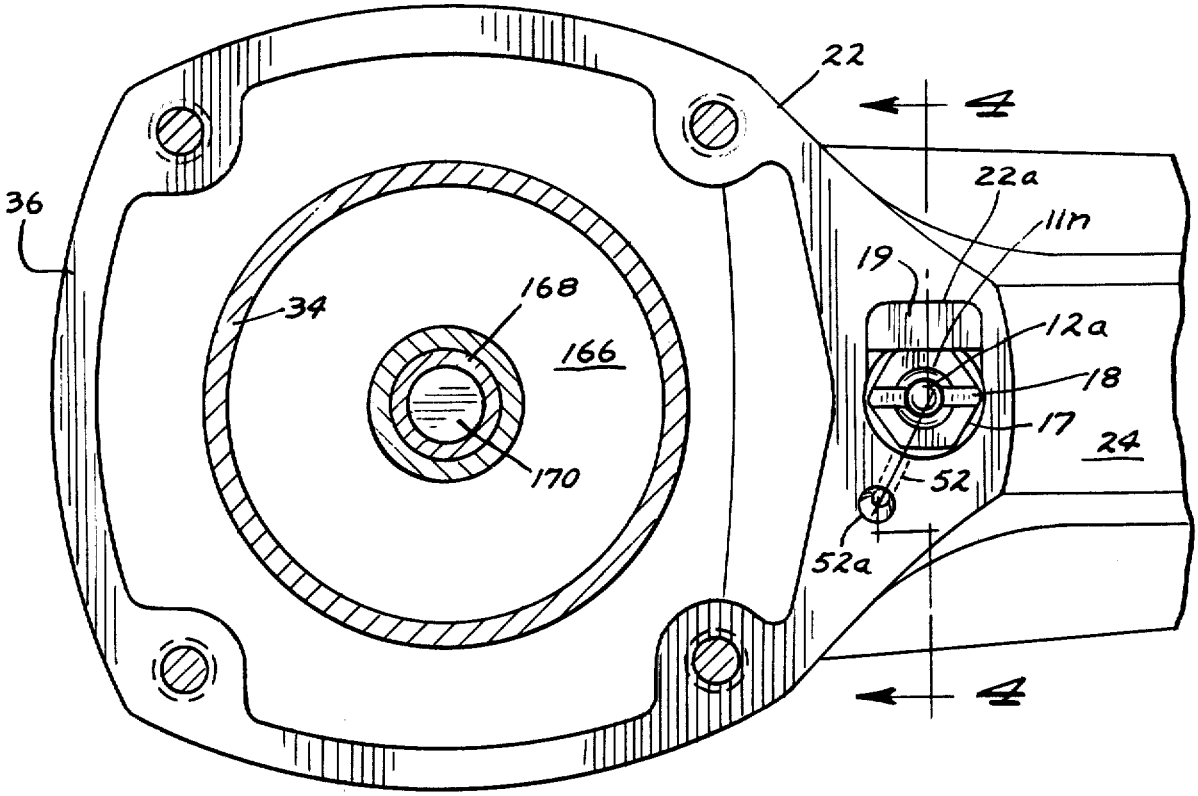
FIG. 3 illustrates a top sectional view taken along line 3—3 of FIG. 2 looking in the direction of the arrows.

FIG. 3, which illustrates a top sectional view taken along line 3—3 of FIG. 2 looking in the direction of the arrows, shows the housing 22, the cylinder assembly 34, the cylindrical body 36, and the piston assembly 166.

Hexagonal sides 17 encompass the top of the valve bushing 11 and an indented slot 18 extends between opposing intersections of the hexagonal sides where slot 18 provides for adjustment of the valve trigger assembly 10 in the nailer 20 and the hexagonal sides provide for locking of position of the valve trigger assembly 10. A key 19 engages into a key indentation 22*a* recessed into the housing 22 of the nailer 20 and engages with any one of the six hexagonal sides 17 of the valve bushing 11. A thirty-degree chamfer 11*n* surrounds the valve piston 12 in the valve bushing 11 as later described in detail.

Figure 4:
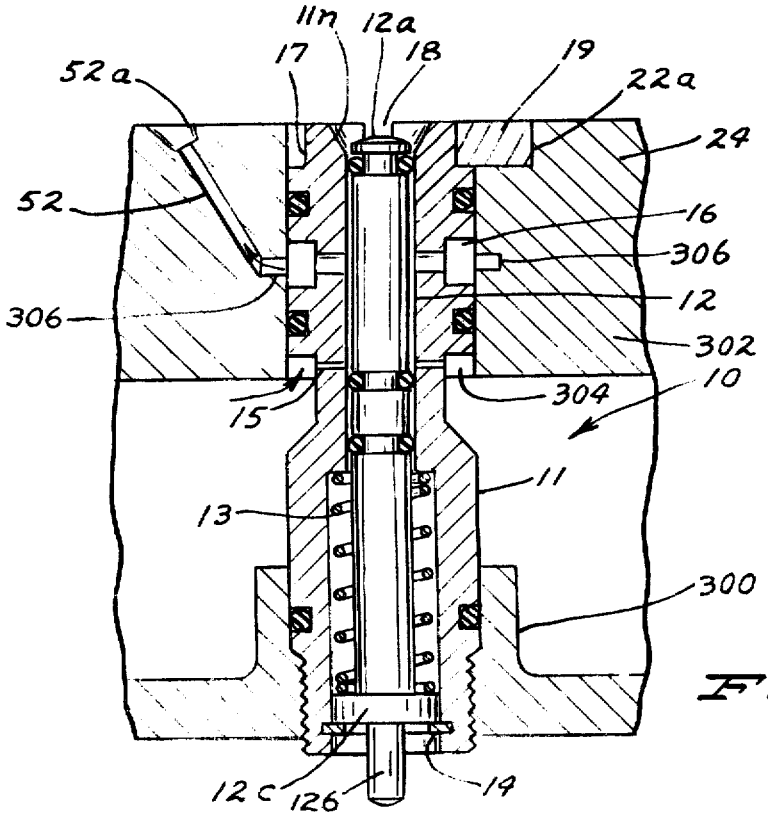
FIG. 4 illustrates a sectional view of the valve trigger assembly in a cutaway view of the pneumatic cylindrical body of the nailer taken along line 4—4 of FIG. 3 looking in the direction of the arrows.

FIG. 4, which illustrates a side sectional view of the valve trigger assembly 10 in a cutaway portion of the housing of the nailer 20 taken along line 4–4 of FIG. 3 looking in the direction of the arrows, shows the valve trigger assembly including the geometrically configured valve bushing 11, the geometrically configured valve piston 12, the spring 13, the snap ring 14, the small holes 15, the large holes 16, the hexagonal sides 17, the indented slot 18, the key 19, air channel 52 with countersunk portion 52*a*, the threaded lower bushing bore 300, the upper bushing bore 302, the inner space 304, and the accumulator chamber 306 connected to the air channel 52. The valve trigger assembly 10 is illustrated in a rest or unactivated position in FIG. 4 for charging the poppet assembly 180 prior to initiating nailing. The top 12*a* of the valve piston 12 extends slightly into the middle of the indented slot 18 and chamfered hole 11*n*.

FIG. 5, which illustrates the geometrically configured valve bushing 11, shows the threaded end 11*a*; the configured upper portions 11*b* and 11*c*; the configured mid-portion 11*d*; the outer O-ring grooves 11*e*, 11*f*, and 11*g*; O-rings 11*h*, 11*i*, and 11*j*; the plurality of small holes 15 being four in number; the plurality of large holes 16 being two in number; and, the hexagonal sides 17. The number of the plurality of small and large holes is by way of example and illustration only, and is not be construed as limiting of the present invention. A valve stem 12*b* extends below the piston 12*a* as described in FIG. 5 and is of reduced diameter with respect to the diameter of the valve piston 12.

Figure 6:
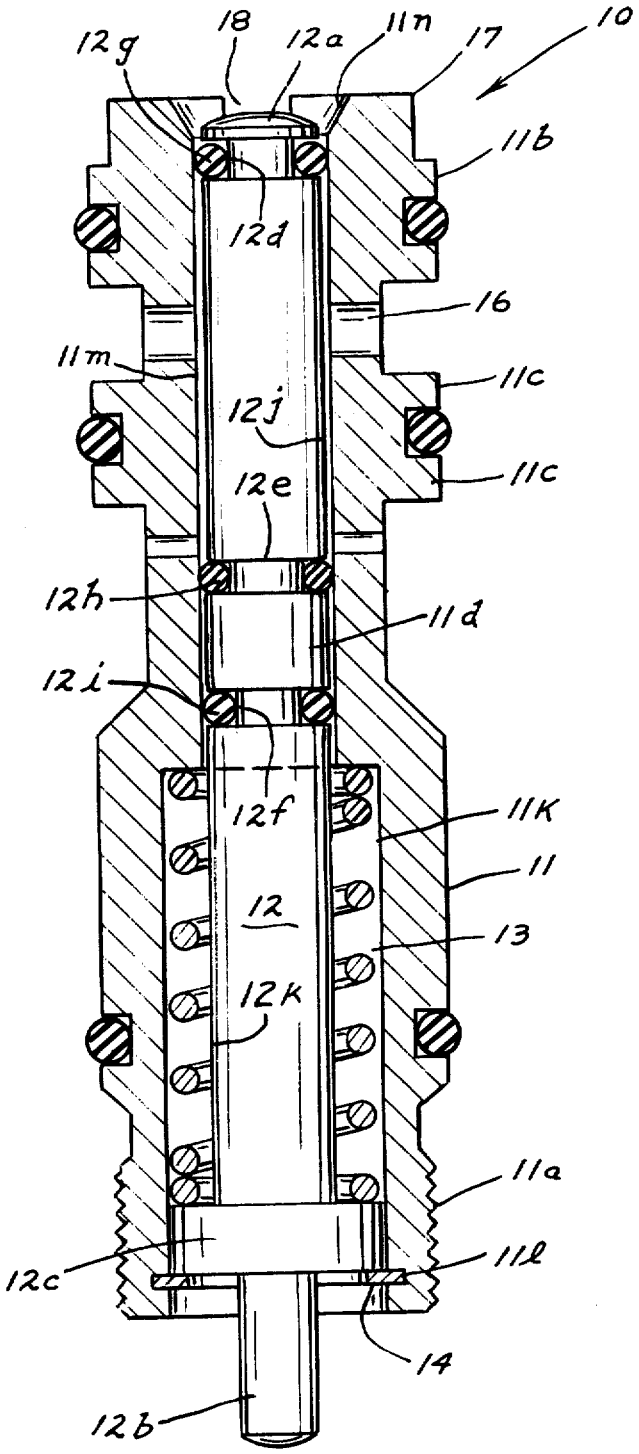
FIG. 6 illustrates an enlarged sectional view taken along line 6—6 of FIG. 5 looking in the direction of the arrows; and, FIG. 7 illustrates an enlarged cutaway view of the valve trigger assembly in an actuated condition.
Figure 7:
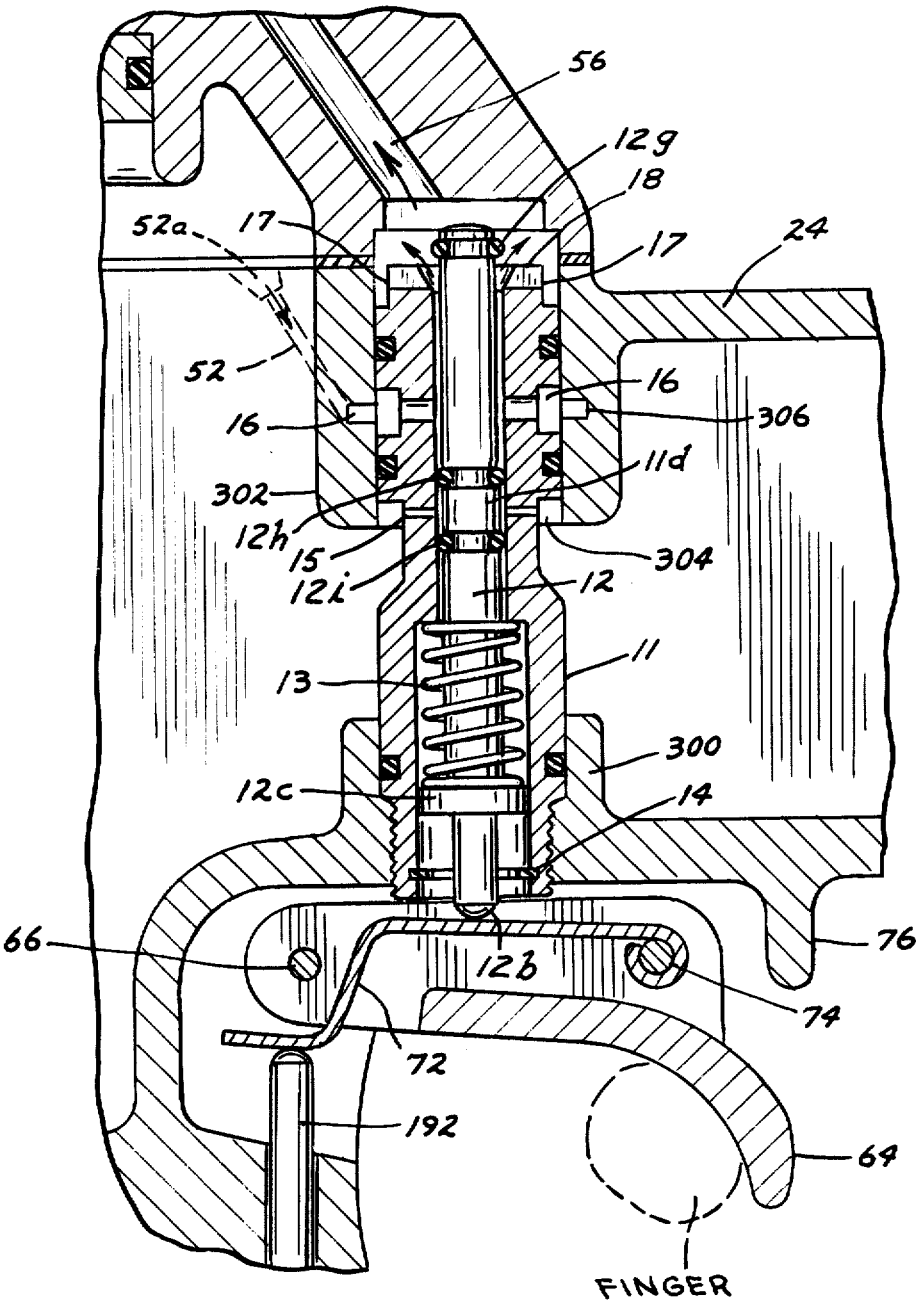

FIG. 6, which illustrates an enlarged cross-sectional view taken along line 6—6 of FIG. 5 looking in the direction of the arrows, shows the particular detail of the valve piston 12 including the chamfered top 12*a*, the valve stem 12*b*, a retainer member 12*c* of enlarged diameter, O-ring grooves 12*d*, 12*e* and 12*f*, and O-rings 12*g*, 12*h*, 12*i*. The valve piston 12 is biased downwardly by the spring 13 which is retained between an upper side of the retainer member 12*c* and an inner diameter 11*k* of the valve bushing 11. The valve piston 12 is retained in the trigger valve bushing 11 by the snap ring 14 which engages into groove 11-l in the valve bushing 11 and against the lower side of the retainer member 12*c*. The upper portion 12*j* of the valve pistion 12 is of reduced diameter with respect to the lower portion of the valve piston such that the clearance between the inner side of the valve bushing 11 and the outer reduced diameter of the valve piston is substantially 1.0 mm providing for charging and discharging of the poppet assembly. The interior diameter 11*m* of the upper portion of the valve bushing 11 is 6 mm and the outer diameter 12*j* of the upper portion of the valve piston is 5 mm. The diameter of the large holes 16 of the valve bushing 11 is 3 mm, and the diameter of the small holes 15 and the valve bushing 11 is 1 mm. The hole diameters, bushing inner diameter, and piston outer diameter are calculated to equalize flow of air pressure as later described. These numerical values are by way of example and for purposes of illustration only, and are not to be construed as limiting of the present invention.

MODE OF OPERATION

The valve trigger assembly 10 is screwed into the lower thread valve bushing bore 300 with a slotted flat-head screwdriver having a centered slot for accommodating the chamfered top 12*a* of the valve piston, and is adjusted to a position so that the large holes 16 align with the accumulator channel 306; and, so that the safety yoke 148 actuates the secondary trigger 72 through safety yoke pin 192 and integral safety yoke lever 158. Adjustment is implemented through the action of the indented slot 18 and once adjustment is determined, the valve trigger assembly 10 is locked in position. The adjustment provides for overlap of the large holes 16 and the accumulator 306 providing for a predetermined and sufficient volume of air to flow through angular channel 52.

The key 19 is positioned between one of the hexagonal sides 18 of the valve bushing 11 and engaged into the key indentation 22*a* in the housing 22 of the nailer 20, thereby locking the valve bushing 11 of the valve trigger assembly 10 in the housing 22 of the nailer 20. The key 19 can engage against any one of the six sides of the hexagonal geometrically configured top 17 of the valve bushing 11. Any number of sides can be provided on the top of the valve bushing 11 as desired. In the event of readjustment or maintenance, the key 19 is easily removed from the key indentation 22*a* with a sharp instrument for subsequent adjustment of assembly 10.

In commencing operation of the nailer 20 with the valve trigger assembly 19 of the present invention and in making reference to the accompanying figures, the nailer 20 is connected to a supply line source of compressed gas such as compressed air through an air hose coupling screwed into the air passage 28 in the end 30 of the nailer 20 as illustrated in FIG. 1. Preferably the supply line is a clean, dry supply of compressed air in the range of 100 pounds per square inch by way of example and for purposes of illustration only, although this is not to be construed as limiting in any sense.

When the nailer 20 is connected to a source of compressed air through the air coupling hole 28, air flows into the housing 22 through the first integral internal air chamber 26, around past the valve trigger assembly 10 of the present invention, around the cylinder assembly 34, and charges the bottom of the poppet assembly 180 with an equalized pressure as illustrated in FIG. 2. At the same time, air flows around the valve trigger assembly 10, flows up through inner aperture 304, in through the plurality of small holes 15, up between the valve bushing 11 and the inner diameter 12*j* of the valve piston 12, and out through the plurality of large holes 16, into an accumulator 306, up through channels 52–52*b*, and into the third integral internal air chamber 50 thereby charging the top of the poppet assembly 180 with equalized air pressure as illustrated in FIG. 2. This flow of air creates a blanket of air over the top and bottom of the poppet assembly 180 where the air on the top of the poppet assembly 180 forces the poppet assembly 180 against the top of the cylinder assembly 34 as the surface area is greater on the top of the poppet assembly 180 than on the bottom of the poppet assembly 180.

Prior to the operation of driving nails, the nailer is loaded with an assembly of collated nails as described in U.S. Pat. No. 4,197,974. Once the magazine 82 of the nailer 20 is loaded with nails, the nailer 20 is ready for operation.

In operation, the operator's hand grasps the upper handle 24 of the nailer 20 with three fingers on one side and the underside of the upper handle 24 behind the trigger boss 76, the palm of the operator's hand positions on the top side of the upper handle 24 and the thumb of the operator's hand wraps around the other side of the upper handle 24. The forefinger of the operator's hand grasps the underside of the trigger 64. The nailer 20 is then positioned for driving a nail where the nose 60 carrying the safety yoke 148 is centered over the desired point of driving a nail into the material.

Once the operator positions the nailer 20 at the point of nailing with the circular nail guide chamber 204 centrally positioned at the point of nail insertion into the material, the operator with the palm of the operator's hand forces the upper handle 24 of the nailer 20 downwardly towards the material to be nailed thereby forcing the safety yoke 148 to slide upwards on the nose 60 against the force of the compression spring 160 accommodated between the spring retainer 162 and the hole 164 in the base 62 of the nose 60. As the safety yoke 148 slides upwards where the elongated holes 150*a* and 150*b* ride in line over the elongated bosses 152*a* and 152*b*, the integral safety yoke lever 158 likewise is carried upwards camming against the safety yoke pin 192 riding in the hole 194 in the cylindrical body 36 against the force of the compression spring 190. When the safety yoke 148 reaches the top point of upward sliding movement where the bottom of the elongated holes 150*a* and 150*b* abut against the bottom of the elongated bosses 152*a* and 152*b*, the safety yoke lever 158 cams the safety yoke pin 192 up against secondary trigger 72 thereby pivoting the secondary trigger 72 on the secondary spiral pin 74 into position for nailing as now described.

While the operator applies force in pushing the nailer 20 downwards toward the material and maintaining the safety yoke 148 in an upward position so that the end 220 of the nose 60 coincides with the lower end of the safety yoke 148, the operator actuates the trigger 64 with the operator's forefinger thereby pivoting the trigger 64 about the trigger spiral pin 66 and carrying the secondary trigger 72 actuated by the safety yoke pin 192 so that the secondary trigger 72 actuates the end of the valve stem 12*b* fortifying the nailer 20 and driving a nail 218 into the material.

When the operator pulls the trigger 64, the secondary trigger 72 is likewise carried upwards and forces the valve piston 12 through the action of the valve stem 12*b* upwards in the valve bushing 11 against the force of the spring 13.

The upward rise of the valve piston 12 results in O-rings 12*h* and 12*i* isolating and blocking the plurality of small holes 15 while O-ring 12*g* first rises out of the inner diameter of the valve bushing 11 and above the slot 18 of the valve bushing 11. Actuating the trigger 64 which carries the secondary trigger 72 blocks air flow in the plurality of small holes 15 thereby keeping supply air pressure out of the chambers and vents air pressure behind the poppet assembly 186 to discharge into the atmosphere as later described in detail. The distance that O-ring 12*h* travels for blocking the flow of air through the plurality of small holes in conjunction with O-ring 12*i* is slightly greater than the distance of travel of O-ring 12*g* which provides for reverse flow of air for venting pressure above the poppet assembly 186 into the atmosphere. While the distance of movement is the same, the distance of travel between the centers of the small holes 15 and the middle O-ring 12*h* is slightly larger than the distance of travel between O-ring 12*g* and the top edge of the inner diameter 11*m* of the valve bushing 11, thereby blocking the small holes 15 after opening the space between diameters 11*m* and 12*j* to the atmosphere which provides that there is no delay in firing action of the nailer.

Figure 7:
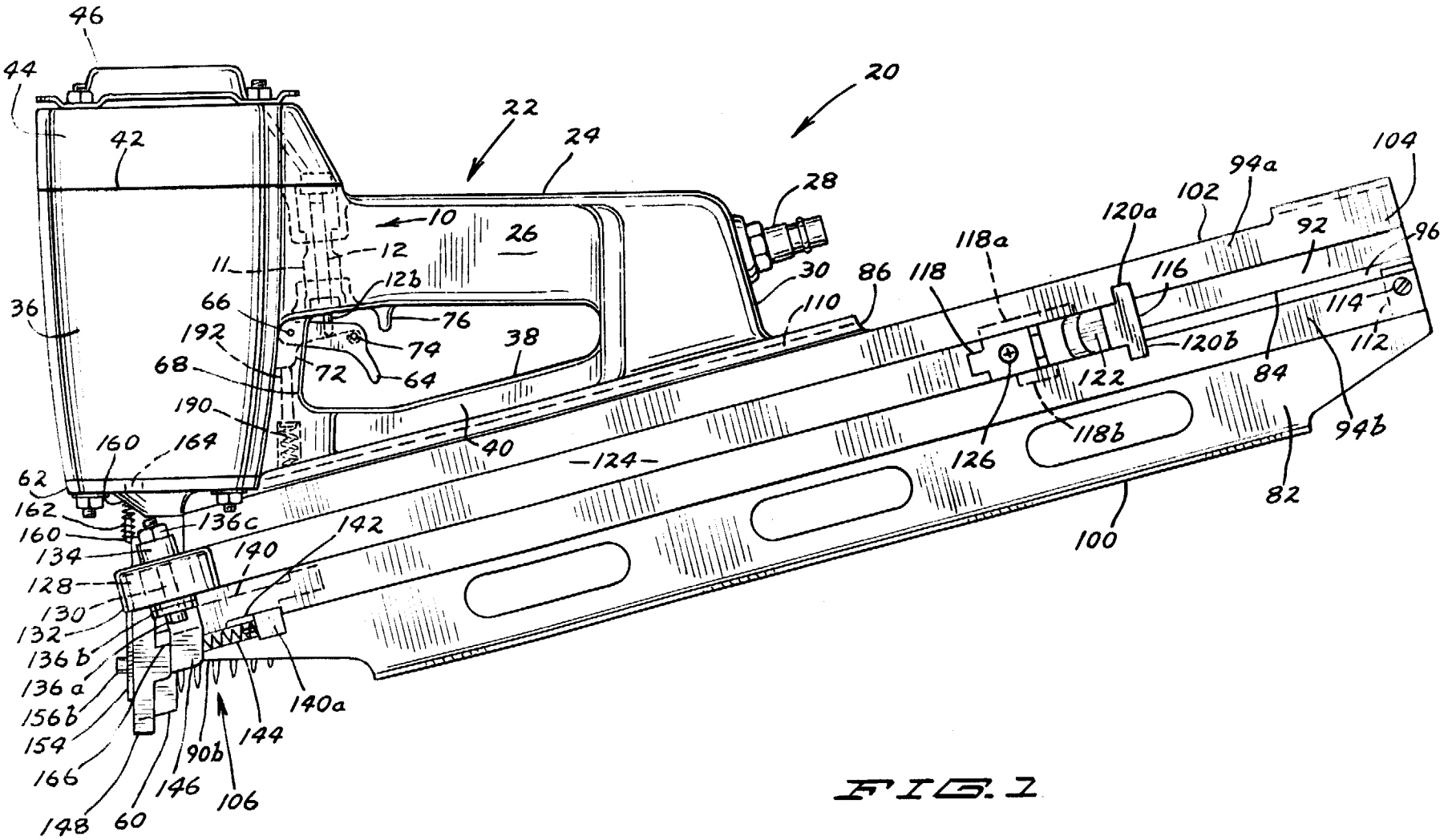

FIG. 7 which illustrates an enlarged view of the valve trigger assembly 10 is an actuated position in the nailer 20 where the top 12*a* of the valve piston 12 extends above chamfer 11*n* and slot 17 as actuated by the trigger 64 carrying the secondary trigger 72 which is actuated by the safety yoke 192 and which actuates the valve stem 12*b* of the valve piston 12. In an actuated position, O-rings 12*h* and 12*i* on the valve piston rise upward to block and isolate holes 15 thereby preventing supply line air pressure from entering the valve trigger assembly 10. O-ring 12*g* on the valve piston 12 rises out of the inner diameter of the valve bushing 11, above chamfer 11*n* and indented slot area 18, and above the top of the valve bushing 11.

On the actuation of the valve piston 12 at the valve stem 12*b* by the secondary trigger 72, the O-rings 12*h* and 12*i* travel a minimal distance of 1.85 mm in isolating the holes 15 as the O-ring 12*h* is just slightly below the small holes 15. The O-ring 12*g* travels a lesser distance of 0.8 mm in opening the holes 16 and associated structure including the accumulator channel 306 and angular connecting channels 52 to the atmosphere through the space between the diameters 12*j* and 11*m* of valve piston 12 and valve bushing 11 respectively. While the O-rings 12*g* and 12*h* move the same distance on the valve piston 12, the O-ring 12*h* is slightly farther from the small holes 15 and therefore a slightly greater distance of travel is required to isolate the small holes than the O-ring 12*g* which is lesser distance from the top of chamfered angled edge 11*n* of the valve bushing 11 and requires less distance of travel to open the interior of the trigger valve assembly 10 to the atmosphere before the small holes 15 have been isolated by the O-ring 12*h* from the supply line air pressure thereby providing for no delay in firing.

At this point, the poppet assembly 180 rises because of the air pressure underneath and surrounding the cylinder assembly 34, and seals off the longitudinal passage hole 58 through the poppet assembly 180 against the rubber seal 183 preventing further air discharge through the piston exhaust 185. The air subsequently circulates around the first integral internal chamber area 26 and forces the piston assembly 166 carrying the driver blade 170 downward in the cylinder assembly 34. An equalizing hole 167 of forty thousandths is provided in the piston 166. When the driver blade 170 is carried by the piston assembly 166 is traveling downward, air is initially released by the driver seal 176 at the tapered end 172 of the driver blade 170 so that only a predetermined desired pressure builds up in the second integral internal chamber 40. This initial release of air function controls the amount of air buildup in the second chamber 40 so that the operation of the nailer 20 is very precise as to the pressure exerted by the driver blade 170 against the nail 218.

As the piston assembly 166 carrying the driver blade 170 travels on the downward stroke, the lower chamber 40 of the cylindrical body 36 charges with air and acts as an air spring to force the piston assembly 166 upwardly on the return stroke. As the piston assembly 166 carrying the driver blade 170 reaches the downward point of travel in the cylindrical assembly 34, the piston assembly 166 reaches a plurality of holes 54 in the wall of the cylinder assembly 34 which stops the lowest point of travel of the piston assembly 166 by equalizing the air pressure in the first and second chambers 26 and 40. The bumper 174 cushions the forward movement of the piston assembly 166 and rebounds the piston assembly 166 upwards on a return stroke.

After dispensing and driving a nail as described above and the operator releases the trigger 64 which thereby releases the secondary trigger 72 against the valve stem **12*b*, the valve piston 12 is baised downwardly in the valve bushing 11 by the spring 13 in assuming a rest position as illustrated in FIG. 2. The valve piston 12 assuming the rest position in the valve bushing 11 shuts the air exhaust off through the exhaust channel 56, opens up the air intake channel 52 to the poppet assembly 180 and recharges the poppet assembly 180 with air so that the poppet assembly 180 is forced against the top of the cylinder assembly 34. Consequently, the valve seal 182 opens so that the air pressure equalizes. The lower pressure in the first chamber 26 forces the piston assembly 166 carrying the driver blade 170 upwards and the air over the top of the piston assembly 166 exhausts out the top of the valve seal 182 through the longitudinal hole 58 in the poppet assembly 180** thereby completing the driving cycle of one nail into the material.

The operator than repositions the nailer 20 at the next desired point of nailing and repeats the cycle as described above for repeated dispensing and driving.

Various modifications can be made to the valve trigger assembly of the present invention without departing from the apparent scope thereof. The spacing of O-rings 12*g* and **12*h*** on the valve piston can be appropriately spaced without departing from the spirit of the present invention.

Having thus described the invention, what is claimed is:

1. Valve trigger assembly for a pneumatic nailer including a pneumatic system having a cylinder assembly, a piston assembly mounted within said cylinder assembly and having a driver blade attached to said piston assembly in said cylinder assembly, a poppet assembly covering said cylinder assembly, and said valve trigger assembly connected between a supply line of air pressure and said pneumatic system in a housing of said nailer, said valve trigger assembly comprising:

a. valve bushing including a geometrically configured bushing, threads positioned on a lower end of said bushing for engagement in said nailer, a geometrically configured outer diameter including a plurality of small holes in a mid-portion of said bushing and a plurality of large holes in an upper portion of said bushing, a geometrically configured inner diameter including an enlarged inner diameter in said lower portion of said bushing and a groove in a substantially lower portion of said enlarged inner diameter;

b. valve piston including a longitudinal member, an upper mid-position of a slightly reduced diameter, a lower portion including an enlarged diameter having finite width which engages with said enlarged inner diameter of said bushing, and a valve stem extending downward of substantially reduced diameter from said enlarged diameter; hexagonal sided top on said valve bushing, a slot running between opposing intersections of said sides of said hexagonal top and a key of rectangular configuration engages in said housing and locks one of said hexagonal sides to said housing;

c. biasing and retaining means including a spring positioned over a lower portion of said valve piston above said enlarged diameter of said valve piston and within said enlarged inner diameter, and a snap ring retainer engaged into said groove, said spring biasing said enlarged diameter of said valve piston downwardly against said enlarged inner diameter of said valve bushing, and said retainer ring engaged into said groove of said valve bushing retaining said spring and valve piston therein; and, d. ring means including a plurality of o-ring grooves and o-rings selectively positioned about said bushing on said upper and lower portions, and o-ring grooves and o-rings selectively positioned about said valve piston at least one o-ring groove and o-ring on a mid-portion of said valve piston and including an o-ring groove and an o-ring in an upper portion of said reduced diameter of said valve piston, said valve bushing o-ring grooves and o-rings include two o-ring grooves and o-rings on each side of said holes of said upper portion of said valve bushing, and an o-ring groove and o-ring on said lower portion adjacent said threads on said lower portion, said o-ring on said valve piston is positioned slightly below said plurality of holes, said o-ring moves a slight distance for blocking and isolating said small holes, said o-ring adjacent the top of said valve piston is positioned a lesser distance from the top of said valve bushing than said o-ring on said valve piston is positioned below said plurality of holes, said lower o-ring blocks and isolates said holes after said large holes communicate with atmosphere, whereby said valve trigger assembly provides for air passage of air supply line pressure from said plurality of small holes to said plurality of large holes between said two o-rings of said valve piston through a channel for charging a poppet assembly of said nailer when said valve piston is in a downwardly biased position in said valve bushing, and provides for passage of air pressure through channels above said poppet assembly to the atmosphere on actuation of said valve stem of said valve piston in reverse biasing said valve piston upward in said valve bushing where said lower o-ring about said valve piston isolates and blocks said plurality of small holes and said pressure above said poppet assembly flows through channels in said pneumatic tool, through said plurality of large holes, and up along said reduced diameter of said valve piston to the atmosphere thereby providing for firing of said nailer and subsequent dispensing of a nail.

2. Valve trigger assembly of claim 1 wherein said plurality of large holes comprise two.

3. Valve trigger assembly of claim 2 wherein each of said large holes has a diameter of 3 mm.

4. Valve trigger assembly of claim 1 wherein said plurality of small holes comprise four.

5. Valve trigger assembly of claim 4 wherein each of said small holes has a diameter of 1 mm.

6. Valve trigger assembly of claim 1 wherein said mid-portion of said valve bushing includes a reduced outer diameter.

7. Valve trigger assembly of claim 1 wherein said reduced diameter of said valve piston is 5.0 mm.

8. Valve trigger assembly of claim 1 wherein said inner diameter of said bushing is 6.0 mm.

* * * * *